United States Patent [19]

Suzuki et al.

[11] Patent Number: 4,538,578

[45] Date of Patent: Sep. 3, 1985

[54] AIR-FUEL RATIO CONTROL FOR AN INTERNAL COMBUSTION ENGINE

[75] Inventors: Atsushi Suzuki; Masakazu Ninomiya, both of Kariya; Katuya Maeda, Obu, all of Japan

[73] Assignee: Nippondenso Co., Ltd., Kariya, Japan

[21] Appl. No.: 572,147

[22] Filed: Jan. 19, 1984

[30] Foreign Application Priority Data

Jan. 20, 1983 [JP] Japan ..... 58-8104

[51] Int. Cl.[3] ..... F02D 9/02; F02D 1/04; F02M 25/06

[52] U.S. Cl. ..... 123/478; 123/480; 123/440; 123/585

[58] Field of Search ..... 123/480, 478, 585, 417, 123/440, 486, 489; 364/431.04, 424; 371/16, 20, 21; 318/561

[56] References Cited

U.S. PATENT DOCUMENTS

| | | | |
|---|---|---|---|
| 4,138,979 | 2/1979 | Taplin | 123/440 |
| 4,335,694 | 6/1982 | Mausner et al. | 123/480 |
| 4,359,983 | 11/1982 | Carlson et al. | 123/585 |
| 4,359,992 | 11/1982 | Asano et al. | 123/480 |
| 4,389,996 | 6/1983 | Yaegashi et al. | 123/585 |
| 4,402,289 | 9/1983 | Ikeura | 123/585 |
| 4,402,294 | 9/1983 | McHugh et al. | 123/480 |
| 4,440,136 | 4/1984 | Denz et al. | 123/480 |

*Primary Examiner*—Raymond A. Nelli

*Attorney, Agent, or Firm*—Cushman, Darby & Cushman

[57] ABSTRACT

A method for controlling the air-fuel ratio in an internal combustion engine which includes the steps of changing the air-fuel ratio to a predetermined extent, detecting changes in the operating conditions of the engine by running the engine on the basis of the changed air-fuel ratio, and correcting the air-fuel ratio in the desirable direction for changing the air-fuel ratio on the basis of the detected desirable direction of change of the air-fuel ratio. The reading of the fuel correction coefficient $K_1$ is carried out by using maps indicating the relationship between the number of fuel injections, the number of engine rotations, or the fuel injection period, and the fuel correction coefficient $K_1$, respectively, for each ON and OFF mode of the bypass air control valve for controlling the air flow, by bypassing a throttle valve, and the fuel injection on the basis of the amount of fuel injection corrections read from the fuel correction coefficient $K_1$.

12 Claims, 10 Drawing Figures

AIR-FUEL RATIO CONTROL FOR AN INTERNAL COMBUSTION ENGINE

BACKGROUND OF THE INVENTION

1. Field of the Invention

The present invention relates to a method and apparatus for controlling the air-fuel ratio in an internal combustion engine, for example, in an automatic vehicle.

2. Description of the Prior Art

In the prior art systems for air-fuel ratio feedback control in an internal combustion engine, the constant altering (so-called "dithering") of the flow rate of the bypass air, which bypasses a series connected air flow sensor and the throttle valve is carried out in such a manner that the air-fuel ratio is changed alternately from a basic or fundamental ratio at predetermined time periods to a rich setting and to a lean setting. The decision of the direction in which to change the basic or fundamental air-fuel ratio, to improve the specific fuel consumption, is made on the basis of this constant dithering, and correction of the basic or fundamental air-fuel ratio is made in accordance with this decision. That is the prior art systems dither the A/F ratio by making minor changes is the actual air flow. The performance of the engine is then monitored to determine whether the change in actual air flow improves or degrades engine performance. The system then adjusts the basic or fundametnal A/F ratio in accordance with this determination to improve specific fuel consumption. A prior art air-fuel ratio control system of this type is disclosed in Japanese Unexamined Patent Publication (Kokai) no. 57-124051.

However, in such a prior art air-fuel ratio control system, the flow rate of the air passing through the air flow sensor is either changed or not changed, depending on the existence or non-existence of the bypass air flow bypassing the series connected air-flow sensor and throttle valve, so that the actual flow rate of the fuel is not always constant. That is, the prior art systems assumed that the dithered A/F ratio holds the amount of fuel constant. Such is not the case. The flow of air through the bypass air path has a significant effect on the amount of air flowing past the air flow sensor. Reacting to this change in air flow, the prior art systems actually altered the fuel quantity in order to try and maintain the basic A/F ratio. Thus, when dithering changed the engine performance, prior art systems could not determine if the change in engine performance was due to the altered air flow or the altered fuel quantity or both. Prior art systems assumed that the change in engine performance was attributable solely to the change in air flow. Thus, when such systems made a decision to alter the basic A/F ratio to improve specific fuel consumption, that decision was based on uncertain data. Hence, it is difficult to correctly decide the direction in which the change of the air-fuel ratio should be made to improve the specific fuel consumption. This gives rise to the problem wherein the air-fuel ratio cannot be properly controlled in order to attain the optimum specific fuel consumption.

SUMMARY OF THE INVENTION

An object of the present invention is to provide an improved method apparatus for controlling the air-fuel ratio in an internal combustion engine in which the correct decision is made regarding which direction the air-fuel ratio should be changed to improve the specific fuel consumption, so that the air-fuel ratio is controlled in a reliable manner, and optimum specific fuel consumption is attained.

In accordance with the present invention, there is provided a method and apparatus in which the correct amount of fuel to be injected into the engine is calculated in order to improve the specific fuel consumption of the engine. Apparatus and method are provided to dither the A/F ratio of the engine, run the engine on the basis of the dithered A/F ratio, detect the changes in the operating state of the engine caused by the dithered A/F ratio, and correct the basic or fundamental A/F in a direction which improves the specific fuel consumption based on the data obtained from running the engine with the dithered A/F ratio.

The basic A/f ratio is corrected by calculating a corrected value $\tau_1$ of the amount of fuel to be injected into the engine. Such corrected value may be derived by correcting the fundamental pulse $\tau$ by a factor $K_1$. $K_1$ corrects the amount of fuel injected to take into account the time delay between opening or closing the bypass air path and the sensing of the change in air flow by the air flow sensor. $K_1$ may be derived by using data maps which provide values of $K_1$ for different values of (a) the number of fuel injections since the bypass air path was opened or closed, or (b) the number of engine rotations since the bypass air path was opened or closed, or (c) the period of the fuel injection since the bypass air path was opened or closed.

The fundamental pulse $\tau$ may be further corrected to take into account the changes in fuel quantity caused by the dithering step affecting the amount of air flowing past the air flow sensor. To perform such further correction, a factor $K_2$ may be calculated based on the actual air flow rates during the last period when the bypass air path was opened and closed, $Q_a(ON)$ and $Q_a(OFF)$, respectively. Thus, $K_2=(Q_a(OFF)/Q_a(ON))-1$. In such a system the corrected value $\tau_1$ may be calculated as follows:

$$\tau_1=\tau(1+K_1K_2/3\%).$$

DETAILED DESCRIPTION OF THE PREFERRED EMBODIMENTS

Before proceeding to the explanation of the method according to an embodiment of the present invention, the characteristic of the rate of change of the air flow through the air flow rate sensor, and the change of pressure in the air intake pipe when the air flow is established through the bypass, will be explained.

In the prior art air-fuel ratio feedback control of an internal combustion engine, the constant altering of the flow rate of the by-pass air which bypasses the series connected air flow sensor and throttle valve is carried out so that the air-fuel ratio is dithered alternately from a basic or fundamental ratio at a predetermined time period to a rich setting and to a lean setting. The prior art systems assumed that the amount of fuel remained constant through the dithering. A decision would then be made as to which direction to change the basic or fundamental air-fuel ratio in order to improve the specific fuel consumption, and correction of the basic or fundamental air-fuel ratio would be made in accordance with this decision.

In such a prior art method, however, the control of the actual flow rate of fuel is uncertain, as it actually changes depending on the status of the air flow bypassing the air flow sensor and a throttle valve. That is, depending on the existence of non-existence of the bypass air flow, changes in the flow rate of the air through the air flow sensor will or will not take place, so that the actual flow rate of the fuel is not really constant.

In the prior art method, when the flow speed of the air through the throttle valve reaches sonic speed, the flow rate of the air through the air flow sensor is constant, even if a change in the pressure in the air intake pipe, due to the opening and closing of the bypass valve, occurs. On the other hand, when the flow speed of the air through the throttle valve falls below sonic speed, the flow rate of the air through the throttle valve, that is through the air flow sensor, is reduced, due to a change in the pressure in the air intake pipe caused by opening the bypass valve.

Figure 1:
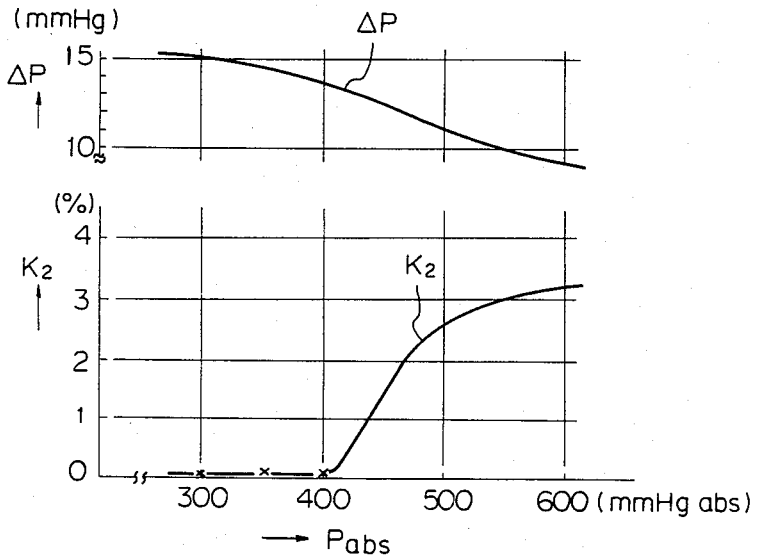
FIG. 1 illustrates the relationship between the absolute pressure in the air intake pipe and the change of the pressure in the air intake pipe, and the rate of change of the flow rate of the air passing the air flow sensor.

The above-described phenomena will be explained with reference to FIG. 1. In FIG. 1, the abscissa represents the absolute pressure $P_{abs}$ in mmHg in the air intake pipe, while the ordinate represents first the change $\Delta P$ in mmHg of the pressure in the air intake pipe where the bypass air flow exists, and second the rate $K_2$ in % of the change of the air flow rate through the air flow sensor. The speed of the engine is selected as 2400 rpm.

As can be seen in FIG. 1, when the absolute pressure $P_{abs}$ in the air intake pipe is below 400 mmHg, although the pressure in the air intake pipe is changed by about 15 mmHg due to the existence of the bypass air flow, the flow rate of the air through the air flow sensor is maintained constant without any change. On the other hand, when the absolute pressure $P_{abs}$ in the air intake pipe exceeds 400 mmHg, i.e., the speed of the air flow through the throttle valve is below sonic speed, the flow rate of the air passing through the throttle valve 17, that is through the air flow sensor, is changed, due to the change of the pressure in the air intake pipe because of the existence of the bypass air flow.

Figure 2:
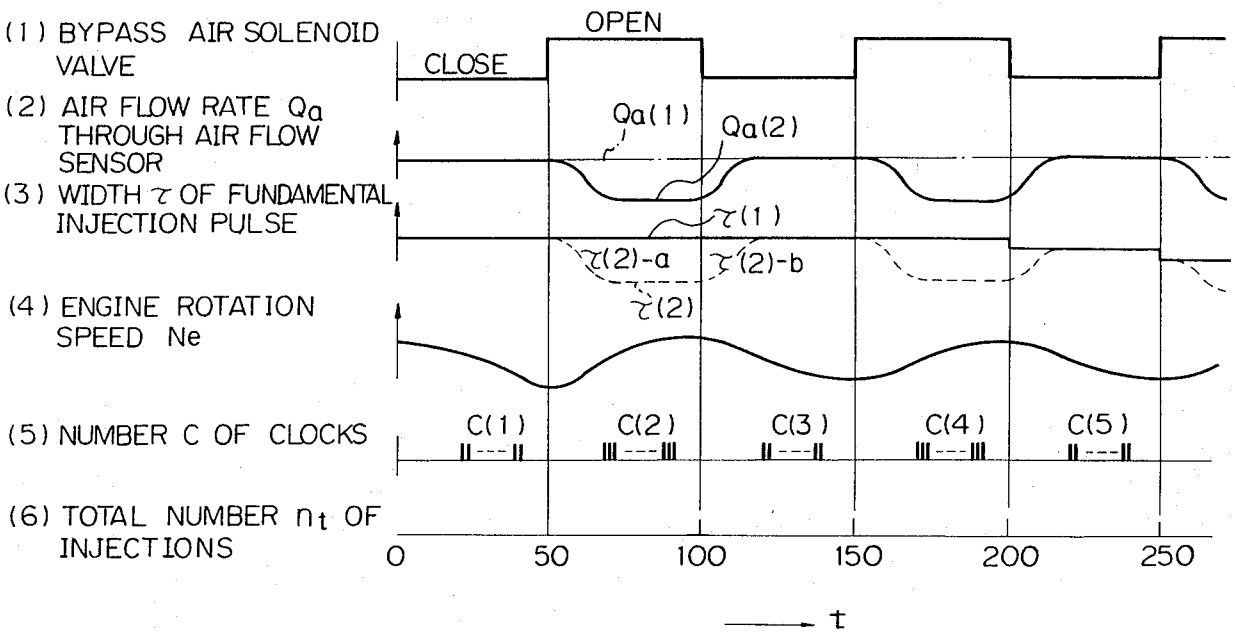
FIG. 2 illustrates the waveforms of the signals in the air-fuel ratio control device for an internal combustion engine.

The above-described characteristic will also be supported by the waveforms, shown in FIG. 2, of the change in the values related to a prior art operation of the device. The abscissa in FIG. 2 represents time. In FIG. 2, (1) shows the closed or open state of the solenoid valve for the bypass air, (2) the flow rate $Q_a$ of the air passing the air flow sensor, (3) the pulse width $\tau$ of the fundamental fuel injection pulse, (4) the rotational speed $N_e$ of the engine, (5) the number C of the clock signals, and (6) the total number $n_f$ of the fuel injections.

In FIG. 2, (2), the flow rate of the air at the air flow sensor when the absolute pressure in the air intake pipe exceeds 400 mmHg abs is represented by the solid line $Q_a$(2), while the flow rate of the air when the absolute pressure in the air intake pipe is below 400 mmHg abs is represented by the chain line $Q_a$(1). The pulse width $\tau$ (FIG. 2, (3)) of the pulse for the fuel injection is calculated from the engine rotational speed $N_e$ (FIG. 2, (4)) and the flow rate of the air passing the air flow sensor.

When the flow rate of the air at the air flow sensor is $Q_a$(2), as illustrated in FIG. 2(2), the calculated pulse width is $\tau$(2), as represented by the broken line $\tau$(2) in FIG. 2, (3). That is when the absolute pressure in the air intake pipe exceeds 400 mmHg abs and the bypass air channel is opened, the amount of fuel supplied to the engine is reduced.

The number C of the clock signals, shown in FIG. 2(5), corresponds to the time in which 50 fuel injections take place. Each of C(1), C(3), and C(5) is a relatively small number, while each of C(2) and C(4) is a relatively large number because it takes longer to supply 50 fuel injections when the bypass air channel is open.

As can be seen from the above description, the consumed fuel amount is not the same in the bypass air ON mode as in the by-pass air OFF mode. Hence, it is impossible to discriminate whether the change of the number of the clock pulses during a predetermined period is caused by the bypass air or by the change of the amount of fuel. Accordingly, it is impossible to find the correct direction in which improvement of the specific fuel consumption is attained.

In the prior art, therefore, there is a problem wherein the control for the optimum specific fuel consumption is not always realized.

Figure 3:
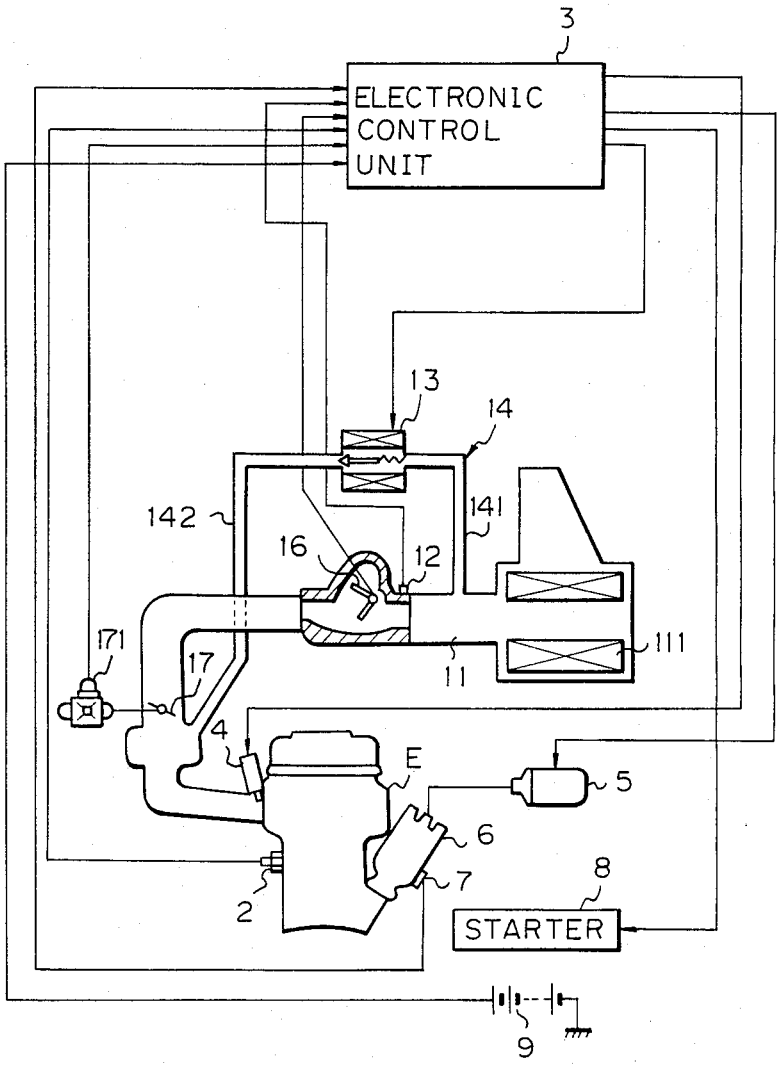
FIG. 3 illustrates the preferred embodiment for controlling the air-fuel ratio in an internal combustion engine.

Next, the embodiments of the present invention will be described. A device for carrying out the method for controlling the air-fuel ratio according to the present invention is illustrated in FIG. 3. In the device shown in FIG. 3, there are provided an engine E, an air cleaner 111, an air intake pipe 11, an intake air temperature sensor 12, a solenoid type bypass control valve 13 for controlling the bypass air passing through a bypass 14 consisting of the upstream portion 141 and the downstream portion 142, an intake air flow sensor 16, a throttle valve 17, and a throttle sensor 171. The bypass 14 is arranged to bypass the portion of the air intake pipe 11 including the intake air flow sensor 16 and the throttle valve 17. The throttle sensor 171 detects the opening degree of the throttle valve 17.

There are also provided a coolant water temperature sensor 2, a fuel injection valve 4, an ignition coil 5, a distributor 6, an engine rotational angle sensor 7, a starter 8 for the engine, a battery 9, and an electronic control unit 3.

The signals from the engine rotational angle sensor 7, the intake air temperature sensor 12, the intake air flow sensor 16, the water temperature sensor 2, and the throttle sensor 171 are supplied to the electronic control unit 3. The output signals of the electronic control unit 3 are supplied to the fuel injection valve 4, the ignition coil 5, the starter 8, and the bypass air control valve 13.

Figure 4:
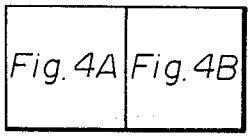
FIGS. 4A and 4B illustrate the structure of the electronic control unit in the device shown in FIG. 3.
Figure 4A:
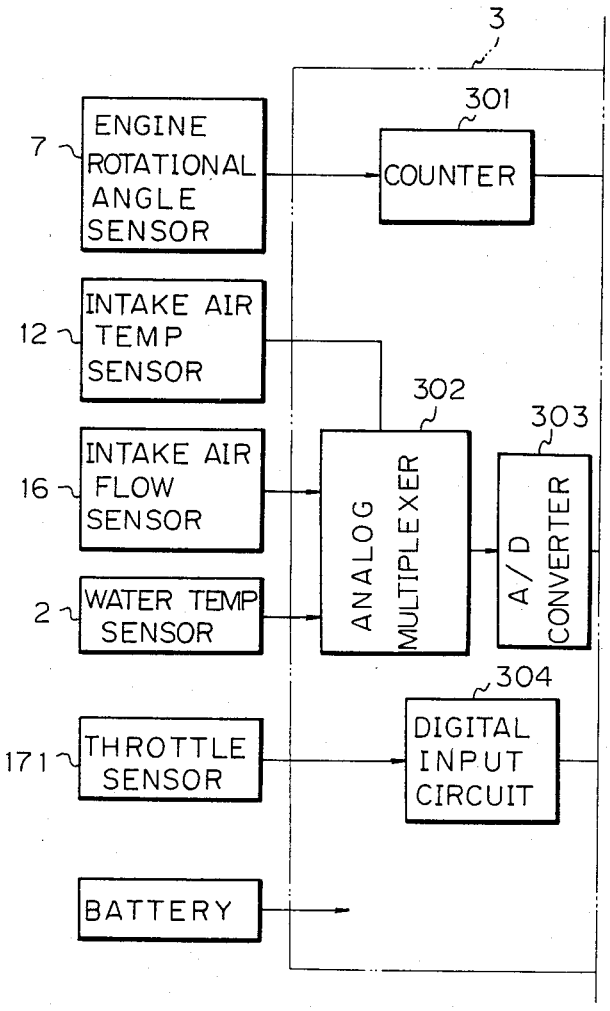
Figure 4B:
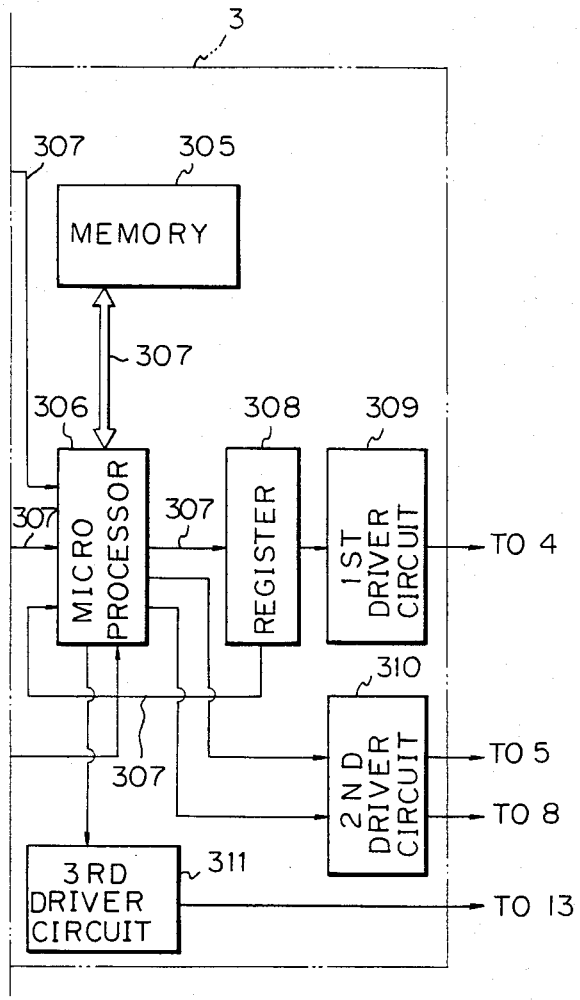

The structure of the electronic control unit 3 in the device shown in FIG. 3 is illustrated in FIG. 4. The electronic control unit 3 includes a counter 301 for receiving the signal from the engine rotational angle sensor 7 and for counting the number of rotations of the engine, an analog multiplexer 302 for receiving the signals from the intake air temperature sensor 12, the intake air flow sensor 16, and the water temperature sensor 2, and for supplying the output signal to the A/D converter 303, and a digital input circuit 304 for receiving the signal from the throttle sensor 171 and for supplying the output signal to a microprocessor 306.

The electronic control unit 3 also includes a microprocessor 306, a memory 305 for storing a program for controlling the engine, a common bus 307, a register 308, a first driver circuit 309, a second driver circuit 310, and a third driver circuit 311.

The register 308 converts the digital signal from the microprocessor 306 into the signal representing the fuel injection period, that is the fuel injection valve open period, of the fuel injection valve 4. The first driver circuit 309 receives and amplifies the pulse signal for the fuel injection from the register 308 and produces the signal for driving the fuel injection valve 4. The second driver circuit produces the signal for driving the ignition coil 5 and the starter 8. The third driver circuit produces the signal for carrying out ON/OFF control of the bypass air control valve 13.

The operation of the electronic control unit 3 is explained as follows.

(i) When the signal from the throttle sensor 171 indicates that the engine is in an idling state, optimum control by the electronic control unit 3 is prevented by the microprocessor 306.

(ii) The pulse width of the driving signal for the fuel injection valve 4 should be selected by taking into account the invalid injection period; which is that period of delay caused by time required for the actual mechanical operation of the fuel injection valve 4 to take place after the application of the driving pulse to the fuel injection valve 4. The invalid injection period is changed in accordance with the voltage of the battery 9, which is why the signal representing the voltage of the battery 9 is used in the operation of the electronic control unit 3.

(iii) When the driving signal, i.e., either ON or OFF, is supplied from the microprocessor 306 to the third driver circuit 311, the information indicating an ON or OFF state of the bypass air control valve is stored in a predetermined address of the memory 305. For example, the information "1" represents an ON state, while the information "0" represents an OFF state. The decision of the state of the bypass air control valve can be then carried out by the microprocessor 306, which checks the above-mentioned predetermined address of the memory 305.

(iv) The decision as to whether or not the engine is in the steady running state is carried out by, for example, comparing regularly, e.g., every 16 msec, the engine rotational speed data at the present calculation timing with that at the preceding calculation timing. If the difference between the compared data is within a predetermined value, it is established that the engine is in the steady running state. It is possible to use the data of the fuel injection amount, instead of the engine rotational speed data. For example, if the fuel injection amount is constant the engine is operating at a steady state.

The operation of the electronic control unit 3 will now be explained using the flow chart shown in FIG. 5. In step S100, the operation is started. In step S101, the engine parameters, such as the water temperature, the intake air temperature, the intake air flow rate, and the engine rotational speed, are read. In step S102, the fundamental fuel injection amount $\tau$ is calculated.

In step 103, the decision as to whether or not the engine is in the steady running state is made by using at least one engine parameter. When the decision is NO, that is, when the engine is in an acceleration state or a deceleration state, the routine proceeds to step S104 in which the $\tau$ calculated in step S102 is stored in a predetermined address AD($\tau$1) of the memory. When the decision in step S103 is YES, the routine proceeds to step S105, in which the decision is made as to whether the bypass air control valve 13 is in the ON mode or in the OFF mode.

When the decision is for the OFF mode, the routine proceeds to step S106, in which the number of the injections since the beginning of the OFF mode is read from the counter 301. The counter 301 is reset to zero every time the ON or OFF is terminated. The count of the counter 301 is incremented by one every time the fuel injection is carried out. Then the routine proceeds to step S107, in which the fuel correction coefficient $K_1$ corresponding to the present count of the fuel injection is read from a map MAP(1).

When the decision in step 105 is for the ON mode, the routine proceeds to step S108, in which the number of injections since the beginning of the ON mode is read from the counter 301. Then the routine proceeds to step S109, in which the fuel correction coefficient $K_1$ corresponding to the present count of fuel injections is read from a map MAP(2).

Figure 6:
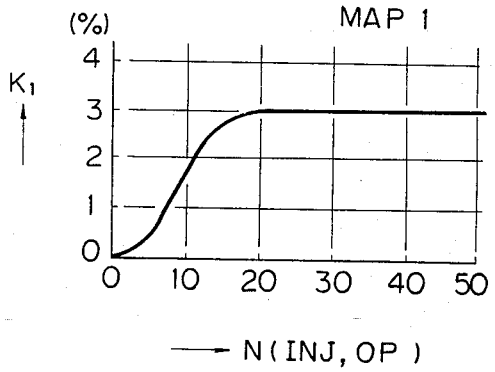
FIGS. 6 and 7 illustrate the relationships between the number of fuel injections and the fuel correction coefficient.
Figure 7:
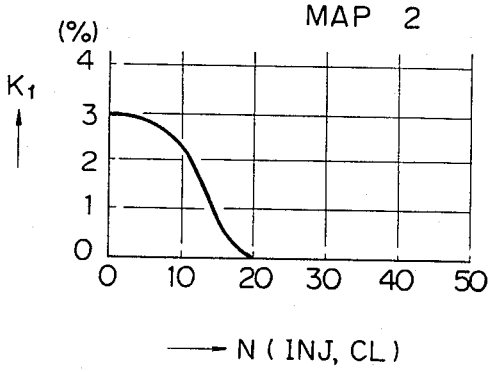

Note, the relationships between the number of injections from when the bypass was opened N(INJ, OP), and the number of injections from when the bypass was closed N(INJ, CL) and the fuel correction coefficient $K_1$ are expressed in the graphs shown in FIGS. 6 and 7. As illustrated in FIG. 2, (1), (2), and (3), there is a time delay between the occurrence of the ON or OFF operation of the bypass air control valve 13 and the change of the flow rate $Q_a$ through the air flow sensor 16, and the fundamental pulse width $\tau$. Hence, after the change from the OFF state to the ON state of the bypass air control valve 13, the map MAP(1) shown in FIG. 6 is used to correct for this time delay, while after the change from the ON state to the OFF state of the bypass air control valve 13, the MAP(2) shown in FIG. 7 is used. That is, the MAP(1) shown in FIG. 6 is used for correcting the portion $\tau$(2)-a of FIG. 2, (3), while the MAP(2) shown in FIG. 7 is used for correcting the portion $\tau$(2)-b of FIG. 2, (3).

The fuel correction coefficient $K_1$, corresponding to the number N(INJ, OP) or N(INJ, CL) of fuel injections indicated in the maps MAP(1) and MAP(2), is previously obtained by an experiment in which the flow rate of the air passing through the intake air flow sensor is changed to the extent of 3% by the constant alterations in the operation of the device. In the present embodiment, the maximum fuel correction coefficient $K_1$(MAX) is selected as 3%.

In practice, the change in the flow rate of the air passing through the intake air flow sensor 16 may be more or less than 3%. Hence, the change in the present flow rate is estimated from the flow rate of the last injection in the preceding constant altering period.

Figure 5A:
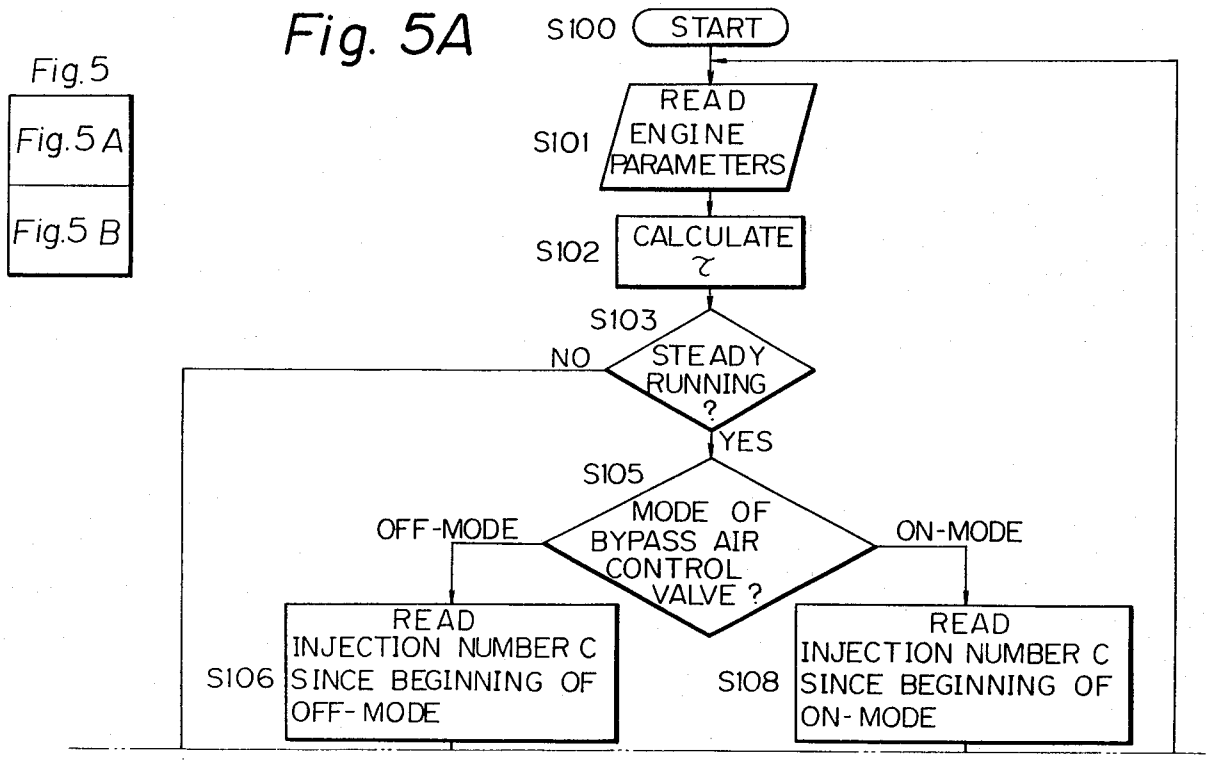
FIGS. 5A and 5B illustrate a flow chart of the operation of the electronic control unit shown in FIG. 4.
Figure 5B:
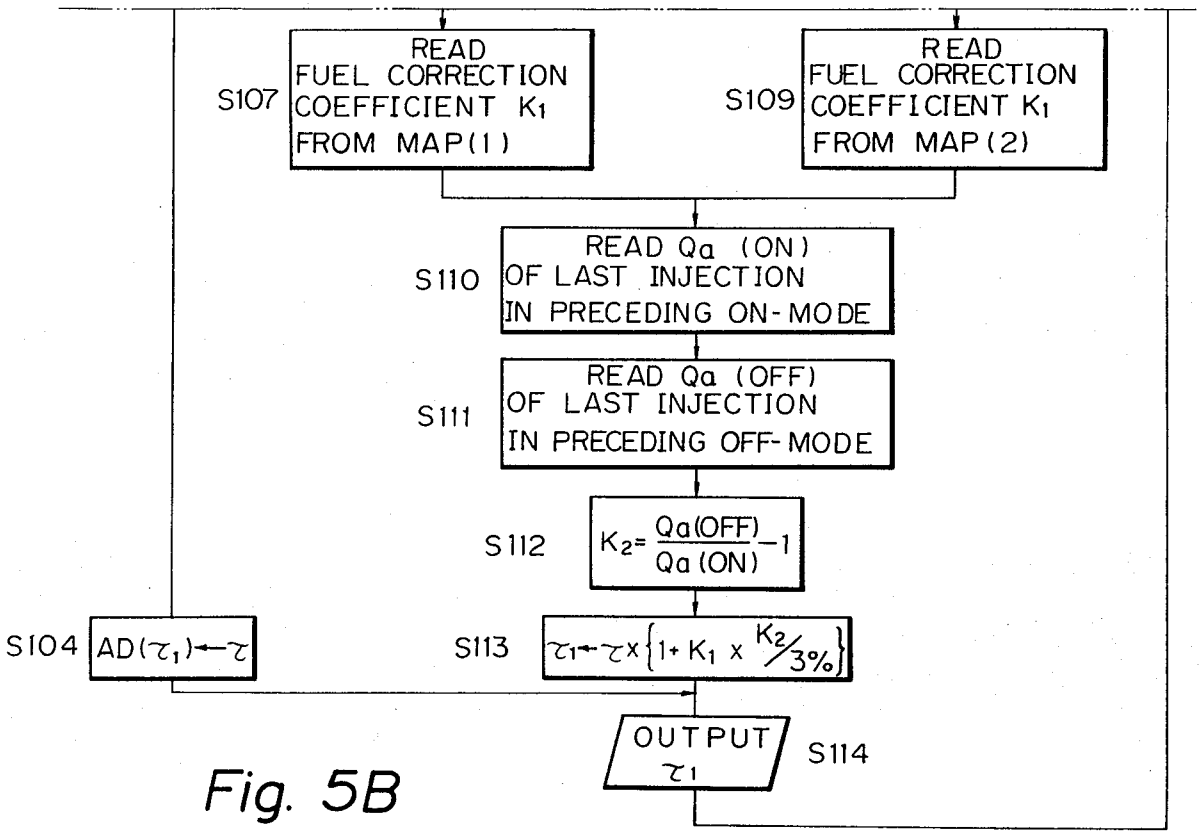

Returning to the description of the flow chart in FIG. 5, in step S310, the intake air flow rate $Q_a$(ON) of the last injection in the preceding ON mode is read. In step S311, the intake air flow rate $Q_a$(OFF) of the last injection in the preceding OFF mode is read. In step S112, the change of the intake air flow rate by the constant altering in the preceding calculation period is calculated and the rate $K_2$ of the change in the air flow rate is obtained, as expressed in the following equation (1).

$$K_2 = \frac{Q_a\,(\mathrm{OFF})}{Q_a\,(\mathrm{ON})} - 1 \qquad (1)$$

The obtained $K_2$ is stored in the memory. In step S113, the modification of the fuel correction coefficient $K_1$ read in the steps S107 and S109 is carried out. In this embodiment, the $K_2$ obtained in step S312 is first divided by 3%. For example, if the $K_2$ is 3%, the quotient of the division is 1, and hence the modified fuel correction coefficient is $K_1$ itself. As another example, if the $K_2$ is 6%, the quotient of the division is 2, and hence the modified fuel correction coefficient is $2K_2$.

In step S113, the correction of the fundamental fuel injection amount $\tau$ is carried out in accordance with the following equation (2).

$$\tau_1 = \tau\left(1 - K_1 \times \frac{K_2}{3\%}\right) \qquad (2)$$

The obtained $\tau_1$ is stored in the address AD($\tau_1$) of the memory.

After step S104 or step S113, the routine proceeds to step S114, in which the obtained $\tau_1$ is delivered as the output. The routine then returns to step S101, and steps S101 to S114 are repeated.

Figure 8:
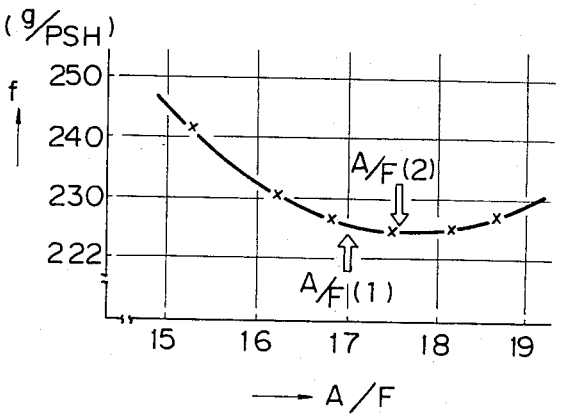
FIG. 8 illustrates the relationship between the air-fuel ratio and the specific fuel consumption.

The relationship between the air-fuel ratio A/F and the specific fuel consumption f in g/PSH obtained from the actual operation of the device shown in FIG. 3 is expressed in the graph shown in FIG. 8. The engine rotational speed and the engine torque are selected as 3200 rpm and 7.5 kg.m, respectively. In FIG. 8, A/F(1) is the air-fuel ratio at the termination of the prior art feedback control, while A/F(2) is the air-fuel ratio at the termination of the feedback control according to the present invention. As expressed in the graph shown in FIG. 8, the air-fuel ratio is controlled to that required to realize the optimum specific fuel consumption.

Although the preferred embodiment of the present invention is described heretofore, various modifications and alterations are possible within the scope of the present invention. For example, instead of the maps MAP(1) and MAP(2), it is possible to carry out the fuel amount correction by the use of maps containing actual past performance data. This is accomplished by storing the air amount per fuel injection data during the constant altering period in a RAM corresponding to the fuel injection, obtaining the rate of change of the air flow rate per each fuel injection due to the ON or OFF mode of the bypass air control using the air flow rate data in the OFF mode of the bypass air control as the reference, and using the obtained rate of change of the air flow rate for the subsequent fuel amount correction. Additional past performance data which may be used to derive $K_1$ include the number of engine rotations since the bypass air path was opened or closed, and the period of the fuel injection since the bypass air path was opened or closed.

According to another embodiment of the present invention, the pulse width in the last calculation timing or near the last calculation timing in the OFF mode of the bypass air control valve is itself used for the pulse width in the subsequent ON mode of the bypass air control valve.

According to another embodiment of the present invention, the actual values of the rate of the change of the data obtained in the electronic control unit, such as the air flow rate per engine rotation Q/N or the $\tau$ itself, is used for the calculation of the fuel correction coefficient, instead of using the rate of change of the intake air flow rate.

In another embodiment of the present invention, the intake air flow rate $Q_a$(ON) and $Q_a$(OFF) near the last injections in the ON mode and near the last injections of the OFF mode are used, instead of the intake air flow rate $Q_a$(ON) and $Q_a$(OFF) in the last injections in the ON and the OFF mode.

In a further embodiment of the present invention, the fuel correction coefficient $K_1$ is calculated by using a predetermined calculation equation, instead of reading the maps MAP(1) and MAP(2).

We claim:

1. A method for controlling the air-fuel ratio in an internal combustion engine, said method comprising the steps of:

dithering the air-fuel ratio about a basic air-fuel ratio to a predetermined extent by using an air path bypassing an air flow sensor in an intake pipe of said engine, said bypass path including a bypass air control valve which may assume one of an ON mode allowing air to pass through said bypass path and an OFF mode prohibitting air to pass through said bypass path;

running the engine on the basis of said dithered air-fuel ratio;

monitoring operating conditions of said engine;

detecting the changes of said operating conditions of said engine;

correcting the basic air-fuel ratio in a desirable direction corresponding to the direction of change of the air-fuel ratio during said dithering which improved the specific fuel consumption as determined by the monitored operating conditions;

determining a fundamental fuel injection pulse $\tau$ based on said corrected basic air-fuel ratio;

correcting said fundamental fuel injection pulse $\tau$ by the application of a fuel correction coefficient ($K_1$) which is derived by using maps which indicate the relationship between said fuel correction coefficient ($K_1$) and one of (a) a number of fuel injections since said air control valve transitioned between said ON and OFF modes, (b) a number of engine rotations since said air control valve transitioned between said ON and OFF modes, and (c) a period of fuel injection since said air control valve transitioned between said ON and OFF modes; and said running step including the step of injecting fuel in accordance with said corrected fundamental fuel injection pulse.

2. A method according to claim 1, wherein said monitoring step includes monitoring air flow with said air flow sensor, and said pulse correcting step includes the the steps of:

calculating a factor ($K_2$) which is indicative of the change of an engine air flow rate, and is based upon a ratio of an air flow rate measured by said air flow sensor when said air control valve is in said OFF mode to an air flow rate measured by said air flow sensor when said air control valve is in said ON mode, said ratio being calculated with air flow rates detected during a previous fuel injection period; and using said factor ($K_2$) to correct the amount of fuel injected.

3. A method according to claim 1, wherein said operating conditions of said engine are an engine rotational speed and an intake air flow rate.

4. A method according to claim 1, wherein said operating conditions of said engine are an engine rotational speed and a pulse width of a signal supplied to a fuel injection valve.

5. A method according to claim 1, wherein said air-fuel ratio is dithered by changing an engine intake air flow rate.

6. Apparatus for controlling the air-fuel ratio in an internal combustion engine having an air flow sensor in an intake pipe, said apparatus comprising:

a bypass path providing an air path, bypassing said air flow sensor;

air control valve means for dithering the air-fuel ratio about a basic air-fuel ratio to a predetermined extent by allowing air to flow through said bypass path in an ON mode and prohibitting air to flow through said bypass path in an OFF mode;

means for running the engine on the basis of said dithered air-fuel ratio;

means for monitoring and detecting changes in operating conditions of said engine;

processing means for: (1) correcting the basic air-fuel ratio in a desirable direction corresponding to the direction of change of the air-fuel ratio during said dithering which improved the specific fuel consumption, as determined by the monitored operating conditions, (2) determining a fundamental fuel injection pulse $\tau$ based on said corrected basic air-fuel ratio, and (3) correcting said fundamental fuel injection pulse $\tau$ by the application of a fuel correction coefficient ($K_1$) which is derived by using maps which indicate the relationship between said fuel correction coefficient ($K_1$) and one of (a) a number of fuel injections since said air control valve transitioned between said ON and OFF modes, (b) a number of engine rotations since said air control valve transitioned between said ON and OFF modes, and (c) a period of fuel injection since said air control valve transitioned between said ON and OFF modes; and said running means including means for injecting fuel in accordance with said corrected fundamental fuel injection pulse.

7. Apparatus according to claim 6, wherein said monitoring means includes said air flow sensor, and said processing means also: (4) calculates a factor ($K_2$) which is indicative of the change of an engine air flow rate, and is based upon a ratio of an air flow rate measured by said air flow sensor when said air control valve means is in said OFF mode to an air flow rate measured by said air flow sensor when said air control valve means is in said ON mode, said ratio being calculated with air flow rates detected during a previous fuel injection period; and (5) uses said factor ($K_2$) to correct the amount of fuel injected.

8. Apparatus according to claim 6, wherein said monitoring means includes means for monitoring engine rotational speed and an intake air flow rate.

9. An apparatus according to claim 6, wherein said monitoring means includes means for monitoring engine rotational speed and a pulse width of a signal supplied to a fuel injection valve.

10. Apparatus according to claim 6, wherein said air control valve means dithers said air-fuel ratio by changing an engine intake air flow rate.

11. A method for controlling the air-fuel ratio in an internal combustion engine having an air flow sensor in an intake pipe to improve specific fuel consumption comprising the steps:

dithering a basic air-fuel ratio to a predetermined extent to produce a dithered air-fuel ratio by changing the mode of a bypass air control valve disposed in a bypass path providing an air path bypassing said air flow sensor between an ON mode allowing air to pass through said bypass path and an OFF mode prohibitting air to pass through said bypass path;

running said engine with said dithered air-fuel ratio;

monitoring the operating conditions of said engine including an air flow rate measured by said air flow sensor;

detecting the changes in said operating conditions caused by said dithered air-fuel ratio;

calculating a fundamental fuel injection quantity $\tau$ based on said basic air-fuel ratio;

supplying said fundamental fuel injection quantity to said engine;

determining whether said bypass air control valve is in said OFF or said ON mode;

determining a number of fuel injections occurring since said bypass air control valve changed mode;

determining a fuel correction coefficient $K_1$ from a data map based upon said number of fuel injections since said bypass air valve changed mode;

reading an air flow rate $Q_a$ (ON) measured by said air flow sensor occurring during a previous fuel injection period when said bypass air control valve was in said ON mode;

reading an air flow rate $Q_a$ (OFF) measured by said air flow sensor occurring during a previous fuel injection period when said bypass air control valve was in said OFF mode;

calculating $K_2$, a rate of change in air flow by the equation $$K_2 = \frac{Q_a\,(\mathrm{OFF})}{Q_a\,(\mathrm{ON})} - 1;$$

calculating a corrected fuel injection quantity $\tau_1$ by the equation $$\tau_1 = \tau(1 + K_1(K_2/3\%));$$

and supplying said corrected fuel quantity to said engine.

12. Apparatus for controlling the air-fuel ratio in an internal combustion engine to improve specific fuel consumption comprising:

means for monitoring the operating conditions of said engine including an air flow sensor disposed in an intake passage of said engine;

a bypass path providing an air path bypassing said air flow sensor;

air control valve means for allowing air to flow through said bypass path in an ON mode and for prohibitting air from flowing through said bypass path in an OFF mode;

means for dithering a basic air-fuel ratio to a predetermined extent to produce a dithered air-fuel ratio by causing said valve means to alternate between said ON and OFF modes;

means for running said engine with said dithered air-fuel ratio;

processing means for: (a) detecting the changes in said operating conditions caused by said dithered air-fuel ratio, (b) calculating a fundamental fuel injection quantity $\tau$ based on said basic air-fuel ratio, said running means supplying said fundamental fuel injection quantity to said engine, (c) determining whether said bypass air control valve is in said OFF or said ON mode, (d) reading a number of fuel injections occurring since said bypass air control valve changed mode, (e) reading a fuel correction coefficient $K_1$ from a data map based upon said number of fuel injections since said bypass air valve changed mode, (f) reading an air flow rate $Q_a$ (ON) measured by said air flow sensor occurring during a previous fuel injection period when said bypass air control valve was in said ON mode, (g) reading an air flow rate $Q_a$ (OFF) measured by said air flow sensor occurring during a previous fuel injection period when said bypass air control valve was in said OFF mode, (h) calculating $K_2$, a rate of change in air flow by the equation $$K_2 = \frac{Q_a\,(\mathrm{OFF})}{Q_a\,(\mathrm{ON})} - 1, \text{ and}$$

(i) calculating a corrected fuel injection quantity $\tau_1$ by the equation $$\tau_1 = \tau(1 + K_1(K_2/3\%));$$

and said running means including means for supplying said corrected fuel quantity to said engine.

* * * * *